United States Patent [19]

Thorkildson

[11] 4,155,312

[45] May 22, 1979

[54] EXTENDABLE SHELF

[76] Inventor: Joel B. Thorkildson, 6321 Fourth Ave., South, Richfield, Minn. 55423

[21] Appl. No.: 869,021

[22] Filed: Jan. 12, 1978

[51] Int. Cl.[2] ..... A47B 11/00; A47F 5/08

[52] U.S. Cl. ..... 108/137; 108/102; 211/90; 211/153

[58] Field of Search ..... 211/90, 153; 108/102, 108/137; 248/149, 208, 300; 52/317, 696

[56] References Cited

U.S. PATENT DOCUMENTS

| | | | |
|---|---|---|---|
| D. 107,062 | 11/1937 | Arenberg | 277/143 |
| 498,563 | 5/1883 | Montgillion | 52/317 |
| 1,043,950 | 11/1912 | Martin | 108/137 X |
| 1,690,910 | 11/1928 | Sharpiro | 211/90 X |
| 2,720,316 | 10/1955 | Glascott | 108/102 X |
| 2,970,872 | 2/1961 | Ullman, Jr. | 108/27 X |
| 3,174,627 | 3/1965 | Marschak | 211/90 X |
| 3,643,607 | 2/1972 | MacKensie | 108/111 |
| 3,765,344 | 10/1973 | Ferdinand | 108/102 X |
| 3,919,950 | 11/1975 | Frazelle | 108/114 |
| 3,955,510 | 5/1976 | Kinik | 108/111 |

*Primary Examiner*—James T. McCall

*Attorney, Agent, or Firm*—Orrin M. Haugen; Thomas J. Nikolai

[57] ABSTRACT

A two piece, lengthwise telescopically adjustable, shelf adapted to be mounted between vertical structural members or studs in a building. The lengthwise adjustability permits use of the shelf arrangement in spite of wide variations in the center-to-center spacing between the structural members.

3 Claims, 3 Drawing Figures

EXTENDABLE SHELF

BACKGROUND OF THE INVENTION

I. Field of the Invention

This invention relates generally to adjustable shelving, and more specifically to the design of a shelf, the length of which may be readily adjusted to fit a wide variety of applications.

II. Description of the Prior Art

The only prior art of which I am personally aware for constructing shelving involves the use of pre-cut wooden, plastic or metal panels of a fixed length and width, which panels are then supported by suitable brackets in a generally horizontal disposition. When it is desired to mount such shelves between building studs in a garage or basement, one must buy shelf members which are pre-cut to fit between adjacent studs or else one must actually cut the shelf member to the appropriate size. Such an approach is relatively costly in terms of both materials and time.

It occurred to me that a need exists for an adjustable shelf which can be manufactured at a relatively nominal cost, but which is adjustable in length so as to be usable in a wide variety of buildings where the center-to-center spacing between building studs may vary anywhere in the range between 1 and 2 feet or even more.

SUMMARY OF THE INVENTION

In accordance with the present invention, there is provided first and second shelving members which telescopically mate, one with the other, so as to form a very rigid planar shelf surface and which may be collapsed or extended to accommodate a desired length thereof. The first shelf member has a generally rectangular planar surface of a predetermined length and width and includes a first integrally formed lip extending perpendicular to the surface of the shelf along a first longitudinal edge thereof. Along the second longitudinal edge of the shelf is a second integrally formed lip which extends generally perpendicular to the plane of the shelf in a direction opposite to the first lip. This second lip includes a "U"-shaped portion along the length thereof, there being a predetermined spacing between the opposed legs of the "U"-shaped portion. The second shelf member is shaped somewhat similar to the first portion but differs therefrom in the relative locations of the U-shaped portion and the lip. More specifically, the orientation is such that the perpendicular lip on the first shelf member is slidably engageable between the spaced apart legs of the "U"-shaped portion on the second shelf member when the edge portion on the second shelf member is slidingly engageable between the spaced apart legs of the "U"-shaped lip on the first shelf member.

Because of the interlocking relationship between the "U"-shaped lip on one shelf member and the associated edge portion of the second member, the construction prevents any substantial sagging of the shelf when the parts are telescopically engaged.

Opposed transverse ends of the first and second members are provided with integrally formed tabs which also project from the plane of the shelf at right angles and which include one or more apertures therethrough to facilitate the fastening of the shelf members in place between building studs.

OBJECTS

It is accordingly the principal object of the present invention to provide a new and improved, low-cost shelf construction.

Another object of the invention is to provide a longitudinally extendable shelf structure for mounting between studs in a wood frame building.

A still further object of the invention is to provide a shelf construction of the type described which is easy to install by persons of only modest skills.

These and other objects and advantages of the invention will become apparent to those of ordinary skill in the art from the following detailed description of the preferred embodiment when considered in light of the accompanying drawings in which like numerals in the several views refer to corresponding parts.

DESCRIPTION OF THE PREFERRED EMBODIMENT

Figure 1:
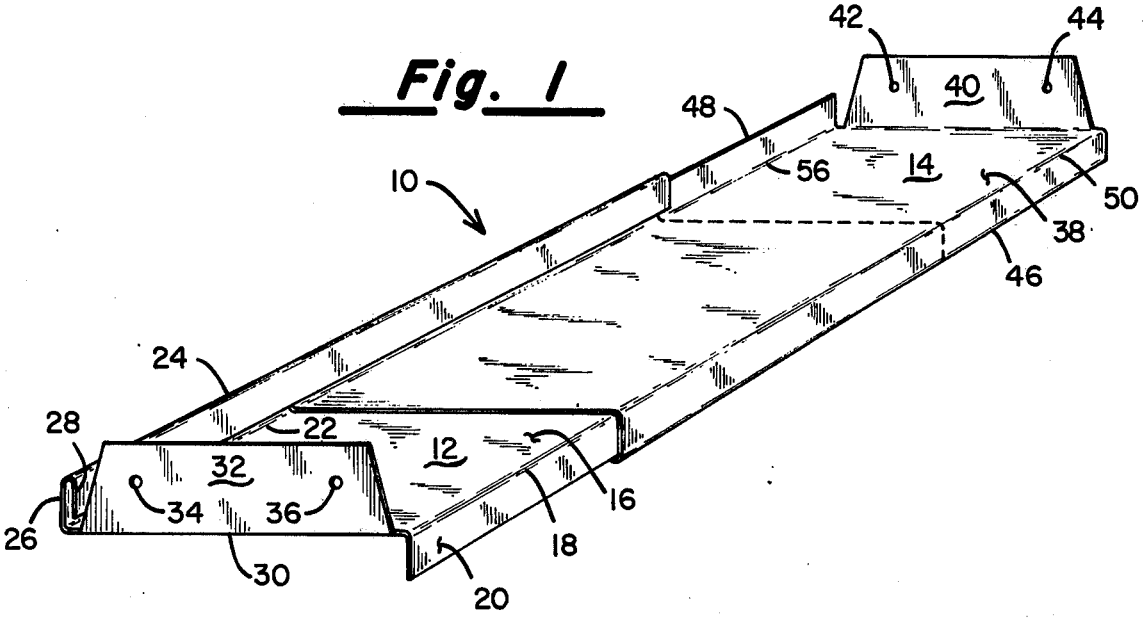
FIG. 1 is a perspective view of the preferred embodiment.
Figure 2:
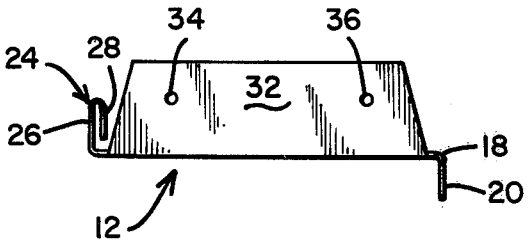
FIG. 2 is an end view of the first shelf member.
Figure 3:
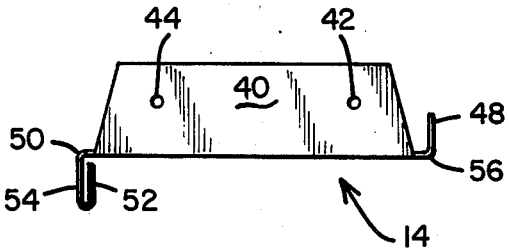
FIG. 3 is an end view of the second shelf member.

Referring first to FIG. 1, there is identified generally by numeral 10 a shelf structure made in accordance with the teachings of the present invention. The composite shelf 10 comprises first and second telescopically mating sections identified by numerals 12 and 14, respectively.

Considering first the member 12, it can be seen that it includes a generally rectangular planar surface 16 of a predetermined length and width and along a first longitudinal edge 18 thereof there is an integrally formed, downwardly depending lip 20 which is generally perpendicular to the plane of the surface 16. This lip 20 extends the full length of the member 12.

Integrally formed along the opposite longitudinal edge 22 of the member 12 is an upwardly extending, generally U-shaped lip 24 having first and second legs 26 and 28 oriented generally parallel to one another but spaced apart by a predetermined distance or gap.

Formed at the leftmost end edge 30 of the member 12 is a generally trapezoidal end tab 32. The tab 32 is preferably at an angle of 90° with respect to the planar surface 16 of the member 12, however, it is a matter of choice as to whether it projects upwardly or downwardly. First and second apertures 34 and 36 are formed through this end tab at predetermined locations to facilitate mounting the shelf member to wooden structural members as by nails or screws.

The shelf member 14 is somewhat similar in its construction to the shelf member 12 in that it includes a generally planar surface 38 of a predetermined length and width and includes an upwardly extending, integrally formed end tab 40 which is oriented generally perpendicular to the surface 38. Again, apertures 42 and 44 are provided in the end tab 40 to facilitate its attachment to a wooden building stud.

The member 14 differs from the member 12, however, in the location and direction of extension of its longitudinal edge lips 46 and 48. More specifically, the member 14 has an integrally formed, downwardly extending "U"-shaped lip 46 along its edge 50 defining generally parallel leg members 52 and 54 which are spaced apart from one another by a predetermined gap or distance. Along its opposite longitudinal edge 56 is the upwardly extending lip 48 which is generally perpendicular to the planar surface 38 of the member 14.

As can best be seen in the perspective view of FIG. 1, the members 12 and 14 are telescopically received one within the other. More specifically, the downwardly extending lip 20 of the member 12 is adapted to fit within the gap between the legs 52 and 54 of the U-shaped lip 46. Similarly, the upwardly projecting lip 48 on the shelf member 14 is adapted to fit within the gap between the legs 26 and 28 of the U-shaped edge 24 of the shelf member 12. When so interlocked, the shelf members 12 and 14 may be collapsed and extended, within limits, to permit its use between building studs which may vary in spacing from building to building or even in the same building. With only a modest amount of overlap, there is very little tendency for the shelf members 12 and 14 to sag because of the interaction of the U-shaped edge lips of one member with the corresponding straight edge lip of the other member.

With no limitation intended, the overall width of the shelf members 12 and 14 may be $3\frac{3}{4}$ inches while the lengths thereof may be approximately 14 inches. As such, the shelf member will conveniently fit between wooden 2×4's which are spaced apart from one another anywhere in the range from 16 to 24 inches. When extended to its 24 inch length, the shelving halves will overlap by approximately 4 inches which is more than sufficient to ensure a sag-free arrangement even when fully loaded.

Also, without limitation, the shelf members 12 and 14 may be formed from sheet metal which is easily cut and formed into the desired configuration. Alternatively, the members may be fabricated from a suitable plastic or even cardboard, depending upon the weight of the items to be shelved.

It can thus be seen that there has been provided a novel construction for an extendable shelf including a novel means for providing a sag-free, telescoping interaction between the separate elements.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

What is claimed is:

1. A two piece, lengthwise adjustable shelf adapted to be mounted between two structural members, comprising:

(a) a first sheet member having a generally rectangular planar surface of a predetermined length and width with a first integrally formed lip extending perpendicular to said planar surface along a first longitudinal edge thereof, a second integrally formed lip extending perpendicular to said planar surface along a second longitudinal edge thereof in a direction opposite to said first lip and including a generally U-shaped portion therealong, there being a predetermined spacing between opposed legs of said U-shaped portion slightly greater than the thickness of said first sheet member and an integrally formed end tab extending perpendicular to said planar surface along one transverse edge thereof;

(b) a second sheet member having a generally rectangular planar surface of a predetermined length and width and a thickness generally equal to the thickness of said first sheet member with a first integrally formed U-shaped lip extending perpendicular to said planar surface along a first longitudinal edge thereof, there being a predetermined spacing between opposed legs of said U-shaped lip slightly greater than the thickness of said second sheet member, a second integrally formed lip extending perpendicular to said planar surface along a second longitudinal edge thereof in a direction opposite said first lip and including an edge portion therealong, and an integrally formed end tab extending perpendicular to said planar surface along one transverse edge thereof, the arrangement being such that said first lip on said first member is slidably engageable between the spaced apart legs of said U-shaped portion on said second member when the edge portion on said second member is slidingly engageable between the spaced apart legs of said U-shaped lip on said first member.

2. The apparatus as in claim 1 and further including first and second spaced apart apertures on each of said end tabs of said first and second members adapted to receive fastening means for securing said slidingly engaged first and second members to structural members.

3. Apparatus as in claim 1 wherein said first and second members are formed from a class of materials including, sheet metal, plastic and cardboard.

* * * * *